United States Patent [19]

Shintani et al.

[11] 4,140,384

[45] Feb. 20, 1979

[54] FILM CONVEYOR

[75] Inventors: Tadashi Shintani; Nobuhiro Takita; Takashi Ohmori, all of Kyoto, Japan

[73] Assignee: Dainippon Screen Seizo Kabushiki Kaisha, Kyoto, Japan

[21] Appl. No.: 807,344

[22] Filed: Jun. 17, 1977

Related U.S. Application Data

[62] Division of Ser. No. 629,065, Nov. 5, 1975, abandoned.

[30] Foreign Application Priority Data

Jul. 11, 1974 [JP] Japan ..... 49-127592

[51] Int. Cl.[2] ..... G03D 3/02

[52] U.S. Cl. ..... 354/321; 354/325; 134/64 P; 134/122 P; 134/131; 226/171; 226/189

[58] Field of Search ..... 354/312, 313, 314, 319, 354/320, 321, 322, 325; 134/64 P, 72, 73, 122 P, 124, 125, 126, 127, 129, 131; 226/170, 171, 172, 189

[56] References Cited

U.S. PATENT DOCUMENTS

| | | | |
|---|---|---|---|
| 2,913,974 | 11/1959 | Sabel et al. | 354/322 |
| 3,263,345 | 8/1966 | Fleisher et al. | 354/319 |
| 3,463,073 | 8/1969 | Knibiehly | 134/122 P |
| 3,532,048 | 10/1970 | Hope et al. | 354/320 |
| 3,608,807 | 9/1971 | Lee | 226/189 X |
| 3,922,702 | 11/1975 | Gaskell | 354/321 |

*Primary Examiner*—L. T. Hix
*Assistant Examiner*—Alan Mathews
*Attorney, Agent, or Firm*—Kleinberg, Morganstern, Scholnick & Mann

[57] ABSTRACT

In a film conveyor for use in developing films comprising a first and a second belt racks consisting of a plurality of narrow belts and pressure rollers, and a roller rack consisting of a plurality of squeegee rollers and spray tubes arranged between said two belt racks, the pressure rollers of the two belt racks are so positioned as to press the belts at the mid points of two vertically adjacent squeegee rollers, and the squeegee rollers of the roller rack are arranged in two vertical rows between which an adequate number of said spray tubes are horizontally disposed so that developing solution may be sprayed out directly toward between said two rows of squeegee rollers. Further, the squeegee rollers of the roller rack are driven in synchronism with the moving speed of the belts so as to effect smooth conveyance of the film held between the belts and the squeegee rollers.

6 Claims, 6 Drawing Figures

FILM CONVEYOR

This is a division, of application No. 629,065, filed Nov. 5, 1975, now abandoned.

This invention generally relates to automatical film developing apparatus, and more particularly relates to improvements in film conveyor composed of a combination of a plurality of belts and squeegee rollers for use in developing exposed films without any developing mark caused thereon.

As is well known by anyone skilled in the art, an automatical film developing apparatus in substance comprises a developing tank, a fixing tank, a water bath and a drying compartment, through all of which exposed films to be developed are automatically conveyed in succession.

Heretofore, various kinds of film conveying means have been proposed, among which a roller conveyor, a belt conveyor and a combination-typed conveyor of rollers and belts have been in relatively frequent use.

As a good example of a film conveyor composed of a combination of belts and rollers, the Japanese Patent published under No. 47-23586 may be taken. However, this conveyor, though it will be described hereinafter in more detail for comparison with the present invention with reference to the accompanying drawings, has recently been observed to have such a disadvantage that some developing marks are apt to emerge on the films, despite the face that this type of a film conveyor has been enjoying a wide reputation among the related fields.

Objects, features and advantages of the present invention will be apparent from the following descriptions of the prior art and the present invention when taken in connection with the accompanying drawings, in which.

Figure 1:
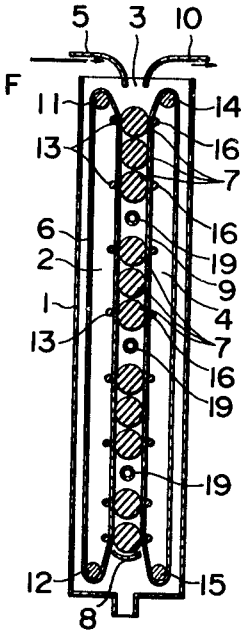
FIG. 1 shows a vertical sectional side view of a developing tank provided with a conventional film conveyor composed of two belt racks and a roller rack.
Figure 2:
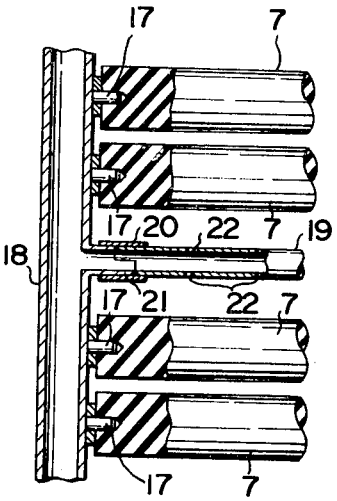
FIG. 2 shows a partial sectional vertical plan view of a roller rack indicated in FIG. 1 in an enlarged scale.
Figure 3:
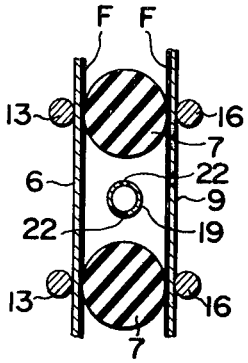
FIG. 3 shows a partially enlarged view of FIG. 2.

Referring first to the construction of the prior art illustrated in FIGS. 1 to 3 inclusive, there is shown a film developing tank 1 within which a first belt rack 2, a roller rack 3 and a second belt rack 4, all of which are vertically standing, are disposed in parallel with one another. An exposed film F to be developed (hereinafter called a "film") is sent into the developing tank 1 along an inducing guide 5. The film F, being held between a plurality of belts 6 on the first belt rack 2 and a plurality of squeegee rollers 7 of the roller rack 3, is then conveyed downward and is revised upward by a revising guide 8 disposed at the lower portion of the roller rack 3. Subsequently, the film F, after being carried upward held between the squeegee rollers 7 (hereinafter called "rollers") and the belts 9 on the second belt rack 4, is discharged along a discharge guide 1 and and is conveyed to a fixing tank (not shown).

The belts 6 on the first belt rack 2 are extending around an upper and a lower pulleys 11 and 12, and are pressed against the roller rack 3 by a plurality of pressure rollers 13 so as to facilitate the positive squeegeeing and downward conveyance of the film F. Similarly, the belts 9 of the second belt rack 4, extending around two pulleys 14 and 15, are pressed against the roller rack 3 by a plurality of pressure rollers 6 of the second belt rack 4.

According to this prior art, a suitable driving means is provided so as to rotate the upper pulleys 11 and 14, and consequently the two belts 6 and 9 around the said two pulleys in a clockwise direction at an equal speed.

As referred to before, the roller rack 3 provided with a plurality of rollers 7 which are vertically aligned is disposed exactly between the said two belt racks 2 and 4. All of these rollers 7, as can best be seen in FIG. 2, are rotatably supported on shafts 17 horizontally protruding from the inner wall of a hollow frame 18 so as to be rotatable in dependence upon the two belts 6 and 9 driven by a suitable means.

An adequate number of spray tubes 19, jointed by sleeves 20 with nipples 21 disposed on the inner wall of the frame 18, are horizontally arranged among rollers 7. Thus, as is the case of most of film developing apparatus, developing solution which is circulatively usable after being treated suitably in a liquid-temperature controller, a circulative pump, etc., flows into the spray tubes 19 through the hollow frame 18, and is sprayed out through numerous spray holes 22 inclinedly excavated on upper and lower sides of the spray tubes 19. In this case, due to these inclined holes 22, solution is sprayed out in an inclined direction relative to axes of rollers 7, thereby effecting an agitation of the developing solution in the tank 1.

As has been apparent from the above outline of the prior art disclosed in a Patent Gazette under No. 47-23586, this apparatus has been proved to be of great use and of high efficiency particularly when developing conventional lithe films, and, to a certain extent, has lived up to the various demands from the related fields.

This apparatus of the prior art, however, has also been proved to have such a drawback that developing marks are often caused on the films, which, according to the inventors' view, may be attributed to positions of the pressure rollers 13 and 16 and dimensions of the squeegee rollers 7.

As mentioned before, it is a jet of developing solution inclinedly gushing forth from the tubes 19 that facilitates an agiation of the solution in the tank 1. In FIGS. 2 and 3, it can be seen that the liquid gushes out through the spray holes 22 toward a roller 7 immediately above or below each spray tube 19. Furthermore, in a film developing apparatus of this type, a number of belts (6 and 9), each of which is narrow in width and made out of reticulate material, are set in parallel with one another on the first and second belt racks (2 and 4), whereby the liquid can flow through the reticulate belts and gaps among the belts, and can make a smooth circulation within the tank 1.

At the same time, however, while the film F is held between the belts 6 or 9 and rollers 7, it can be observed that there is always existing an area where a flow of the solution is intercepted by the film F being conveyed. Especially when a great number of films are to be processed in succession, a sealed portion may be formed surrounded by two rollers 7 adjoining each other and the film F, as can be seen in FIG. 3.

In an extreme case, a film which is as wide as the transverse length of the roller 7 would form a perfectly sealed portion and thus halt every flow of solution.

In any case above, supplementary solution which has been suitably refined does not throughly mix with the rest solution existing in the tank and an ill circulation of the solution takes place, all of which would become a major cause for developing marks on the films.

It is well known that by-products (mainly bromide) originating from an emulsion-coated film during developing process are dissolved in developing solution. If the solution is not throughly agitated, the by-products, before being removed, are re-supplied onto the film surface during the rotation of the squeegee rollers 7, which will also become a cause for developing marks.

A plurality of pressure rollers 13 and 16 are disposed at a position directly opposite to the squeegee rollers 7 through belts, as illustrated in FIGS. 1 and 3. Therefore, if there is some misalignment in any one of these rollers 7, the pressure upon the film F will be uneven and thus a squeegee process for removing exhausted solution from the film surface coated with emulsion will be adversely affected. This will similarly cause developing marks on the films.

Furthermore, as another mechanical disadvantage of this prior art, it may be pointed out that the squeegee rollers 7 are not driven directly by a separate driving means, but instead are entirely in dependence upon the pressure of the belts 6 and 9; because if the rotation of the rollers 7 relies upon the frictional engagement with the moving belts some crystals of chemical agents in the solution are likely to stick to the shafts 17 on which the rollers 7 are rotatably supported, and thus their smooth rotations would be prevented. This will become main cause for scratches or damages of the film surface.

Therefore, it is an important and prime object of the present invention to provide an improved film conveyor for use in develoing films in which all of the above-mentioned drawbacks and disadvantages of the prior art are completely eliminated.

Figure 4:
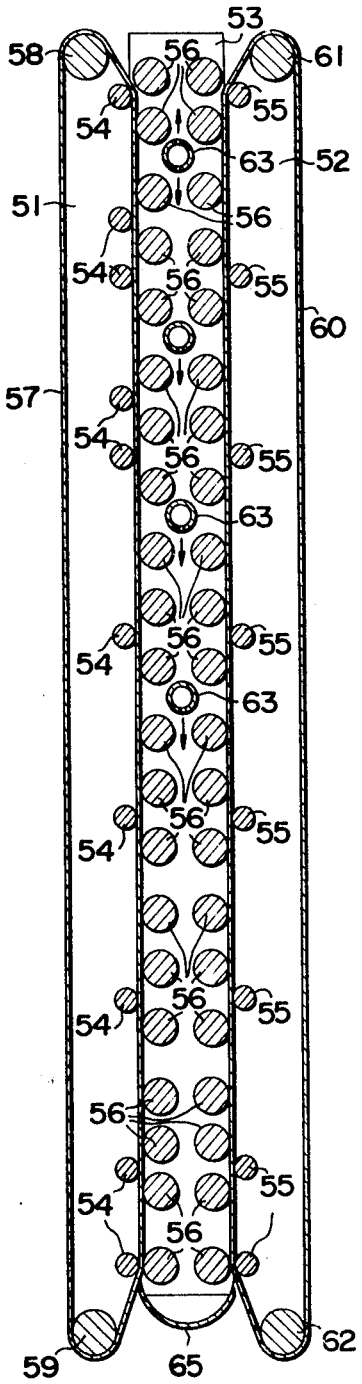
FIG. 4 shows a vertical sectional view of one embodiment of a film conveyor of the invention with a pair of belt racks and a roller rack combined together.

Referring now to FIG. 4 wherein shown is an improved film conveyor of the invention composed of a first and a second belt racks 51 and 52, and a roller rack 53. The construction of the invention is substantially same as that of the conventional one, except for positions and the number of pressure rollers (54 and 55), and dimensions and the number of squeegee rollers 56 (hereinafter referred to as "rollers") of a roller rack 53.

In other words, belts 57 of the first belt rack 51 are extending around an upper and a lower pulleys 58 and 59; whilst belts 60 of the second belt rack 52 similarly extending around two pulleys 61 and 62. Those belts 57 and 60 are pressed against the roller rack 53 by a plurality of pressure rollers 54 and 55 respectively, the number of which, needless to say, depends on the characteristics of the films to be developed.

The roller rack 53, in accordance with the present invention, comprises a plurality of rollers 56 having smaller diameter than the prior art apparatus, as is apparent from comparing FIG. 4 with FIG. 1. These rollers 56 are arranged in two rows; one row of the rollers 56 are constantly in contact with the belts 57 on the first belt rack 51, while the other row being in contact with the belts 60 on the second belt rack 52. Further, these two rows of rollers 56 are spaced apart from each other so that a free flow and circulation of developing solution within the developing tank (not shown) can be ensured.

An adquate number of spray tubes 63 having spray holes 64 thereon for spraying out solution — though only four spray tubes are shown in FIG. 4, the number, of course, will be more in a real construction — are disposed in parallel with the rollers 56 and exactly between the two rows of them. In this instance, according to one embodiment of the present invention, solution is sprayed out toward between said two rows as shown in FIG. 4 by an arrow, while in the conventional apparatus in FIG. 1 it is sprayed out toward a roller immediatly above or below a spray tube.

Therefore, it will be appreciated that, even when a film is held between the belts (57 or 60) and the rollers 56, a sealed portion is not produced anywhere, and further that supplementary solution gushing forth from spray tubes 63 can easily spread all over through between the two rows of the rollers 56 and thoroughly mix with the rest so that the state of the solution in the tank is kept substantially constant as a whole.

It will be also appreciated that chemical by-products of an emulsion dissolving in the solution are quickly removed from the surfaces of the rollers 56 because they are always washed off by suplementary solution.

Figure 5:
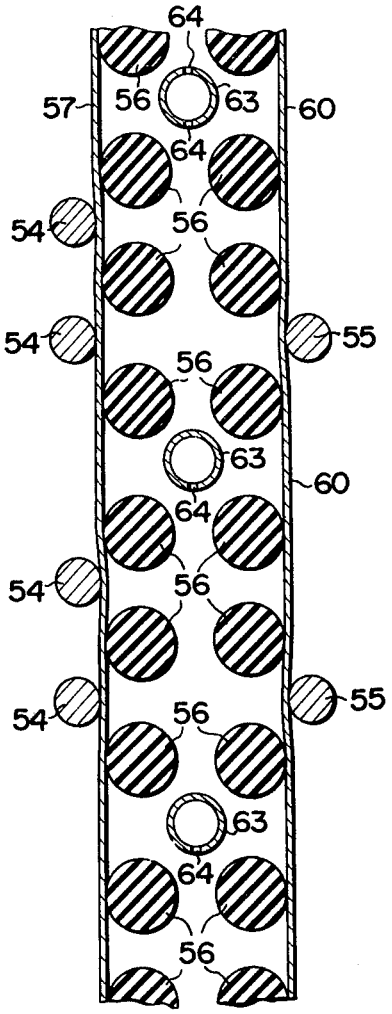
FIG. 5 shows a partially enlarged view of FIG. 4.

As can best be seen in FIG. 5, the pressure rollers 54 and 55 of the two belt racks 51 and 52 are not directly vis with the squeegee rollers 56 of the roller rack 53, but instead are arranged in such a manner that they press the belts 57 and 60 at the mid points of the two rollers 56 adjacent to each other. Accordingly, even if there exists a misalignment in any one of either rollers 56 or the pressure rollers (54 and 55), this misalignment or irregularity may be compensated by a flexibility of the belts made of reticulate material, and, therefore, a squeegee process for removing exhausted solution from film surfaces will not be adversely affected.

What is more, the fact that in comparison with the prior art apparatus the diameter of the squeegee rollers 56 of the present invention is much smaller, at least less than a half, lends itself to making the squeegee process more efficacious and thus preventing developing marks caused on the films. This is apparently because the smaller the diameter of the squeegee roller, the more increased the pressure upon the film surface.

In other words, when the film coated with gelatinized emulsion is bathed in developing solution, the gelatinized emulsion tends to absorb some developing solution and consequently gets swollen. What is required to prevent developing marks from emerging on the films is to thoroughly agitate the solution and, at the same time, to successively replace the exhausted solution soaked into the emulsion with supplementary solution. To do so, it is the most preferred to make the squeegeeing by rollers as efficacious as possible.

As has become apparent from the above, it is one of the major advantages of the present invention that the squeegeeing by individual rollers in cooperation with belts is more effectively done than the prior art.

It is another advantage over the prior art that more frequent squeegee is given to each film being conveyed in a developing tank since more squeegee rollers of smaller dimension can be provided in the roller rack.

Figure 6:
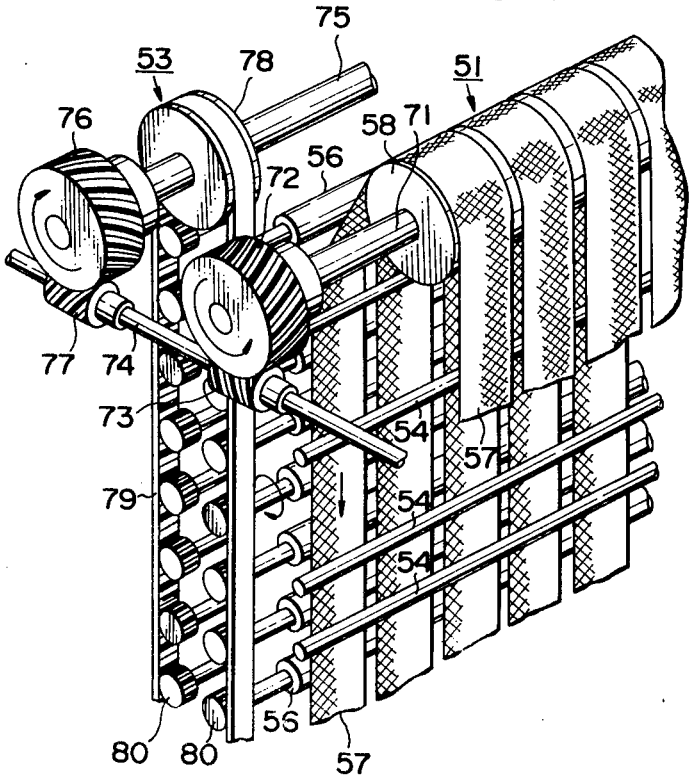
FIG. 6 shows a partial perspective view of a driving mechanism for belts and squeegee rollers, other elements unnecessary for an understanding of the invention having been omitted.

Furthermore, a film conveyor of the invention is employing a driving means to rotate the rollers 56 synchronously with the moving speed of the belts 57 and 60, as perspectively viewed in FIG. 6, wherein some other elements unnecessary for an understanding of the invention have been omitted thereform.

Mounted on a shaft 71 is a worm wheel 72 coaxial with the upper pulley 58 of the first belt rack 51. This worm wheel 72 engages with a worm 73 which is mounted on a worm shaft 74 perpendicular to the shaft 71. There is provided a suitable driving means for driving the shaft 74, thereby rotating the worm wheel 72 in such a direction as shown by an arrow in FIG. 6, and simultaneously rotating the pulley 58 in the same direction. Thus, a plurality of belts 57 extending around the two pulleys 58 and 59 also rotate in a direction to convey a film into the developing tank.

On the other hand, in the roller rack 53 there is also provided a means for rotating all of the rollers 56 at the same speed as the belts 57. Provided on the upper portion of the roller rack 53 is a shaft 75 on which mounted is another worm wheel 76 engageable with another worm 77 on the worm shaft 74. In this case, it should be noted that an angle of torsion of the said two worms 73 and 77 is in an inverse relationship to each other so that the two worm wheels 72 and 76 rotate in an opposite direction. A gear 78 is mounted on the shaft 75 coaxially with the worm wheel 76. A timing belt 79 is extending around the gear 78 and another gear (not shown) rotatably supported on the lower portion of the roller rack 53. A gear of small dimension, which is engageable with the timing belt 79, is mounted on one end axially extending from each roller 56.

When the two worms (73 and 77) and the two worm wheels (72 and 76), though their angles of torsion are exactly inverse respectively, have the same pitch and the same number of teeth respectively, further when the outer diameter of the upper pulley 58 is same as the pitch diameter of the gear 78, and when the pitch diameter of each gear 80 is diameter of each roller 56, it is assured that the rotating speed of each roller 56 is constantly same as the moving speed of the belts 57.

Accordingly, it will be understood that the rollers 56 can roll over and keep close contact with the surface of the film being conveyed, while rotating at the same speed as the belts 57 and 60, whereby the film can be positively conveyed without any scratch or damage caused thereon.

As has been described heretofore, the improved film conveyor according to the present invention is composed of a a simple but the most ideal combination of belts and rollers, and can bring about a satisfactory result when developing films such as lith films or the like.

It should be further noted that the foregoing description is a preferred embodiment of the invention and that various modifications or changes may be made without departing from the spirit or the scope of the invention.

What we claim is:

1. Apparatus for developing photographic film, comprising:

a developing tank;

first and second belt racks disposed in said tank, each rack including at least one belt extending along a predetermined longitudinal direction of said developing tank;

a plurality of squeegee rollers disposed in a first longitudinal row and in a second longitudinal row defining a longitudinally open through space between said first and said second rows to permit free circulation in the longitudinal direction between said first and said second rows of squeegee rollers, said rollers being disposed between said belts to press film against the belts;

moving means coupled to said belts to move the at least one belt in said first rack in an opposite direction from the at least one belt in said second rack so that film pressed against said first belt in said first rack moves in a longitudinal direction opposite from film pressed against said belt in said second rack; and spraying means for spraying fluid-developing chemicals onto film pressed against said belt, including a spray tube in said longitudinally open through space having a plurality of spray holes located in said longitudinally open through space to apply the developing chemicals onto the film and onto said rollers and to agitate the developing chemicals in said through space to remove chemical wastes;

each of said rollers having a diameter substantially less than the shortest distance between said belt racks whereby to minimize entrapment of chemicals.

2. The apparatus of claim 1 wherein said moving means includes means for rotating said squeegee rollers synchronously in a direction to aid the advancement of the film through said tank.

3. The apparatus of claim 1 further comprising pressure rollers for urging said at least one belt in each rack against film between said belt and said squeegee rollers, said pressure rollers being positioned along the longitudinal direction between the positioning of said squeegee rollers so that the pressure of said pressure rollers and of said squeegee rollers is not applied to any part of the film at the same time.

4. The apparatus of claim 1 wherein each squeegee roller has an axis, and the axes of all squeegee rollers are parallel to each other and to said spray tubes.

5. The apparatus of claim 4 wherein said spray holes are positioned on said spray tube to flow said developing chemicals in a circulation flow substantially perpendicular to the orientation of said parallel axes and spray tubes.

6. The apparatus of claim 5 wherein said longitudinal direction is substantially vertical.

* * * * *

UNITED STATES PATENT OFFICE

CERTIFICATE OF CORRECTION

Patent No. 4,140,384 Dated February 20, 1979

Inventor(s) Shintani, Tadashi; Takita, Nobuhiro; and Ohmori, Takashi

It is certified that error appears in the above-identified patent and that said Letters Patent are hereby corrected as shown below:

Column 1, line 31 after "despite the", change "face" to

-- fact --;

Column 1, line 67, after "guide", change "1" to

-- 10 --;

Column 2, line 50, after "tates an", change "agiation" to

-- agitation --;

UNITED STATES PATENT OFFICE

CERTIFICATE OF CORRECTION

Patent No. 4,140,384 Dated February 20, 1979

Inventor(s) Shintani, Tadashi; Takita, Nobuhiro; and Ohmori, Takashi

It is certified that error appears in the above-identified patent and that said Letters Patent are hereby corrected as shown below:

Column 3, line 38, before "films in", change "develoing" to -- developing --;

Column 4, line 11, before "above or below", change "mediatly" to -- mediately --; and Column 5, line 34, before "diameter", insert -- same as the --.

Signed and Sealed this

*Eighteenth* Day of *September 1979*

[SEAL]

*Attest:*

*Attesting Officer*

LUTRELLE F. PARKER

*Acting Commissioner of Patents and Trademarks*

UNITED STATES PATENT OFFICE

CERTIFICATE OF CORRECTION

Patent No. 4,140,384 Dated Feb. 20, 1979

Inventor(s) TADASHI SHINTANI et al.

It is certified that error appears in the above-identified patent and that said Letters Patent are hereby corrected as shown below:

Col. 2, line 8, change "6" to --16--.

Signed and Sealed this

*Eighteenth* Day of *December 1979*

[SEAL]

*Attest:*

SIDNEY A. DIAMOND

*Attesting Officer*

*Commissioner of Patents and Trademarks*